US006650848B1

(12) United States Patent
Regelsberger et al.

(10) Patent No.: US 6,650,848 B1
(45) Date of Patent: Nov. 18, 2003

(54) IMAGE-FORMING DEVICE HAVING ON-LINE IMAGE QUALITY ASSESSMENT AND RELATED METHOD

(75) Inventors: Matthias H. Regelsberger, Rochester, NY (US); Alfred Gonnella, Jr., Rochester, NY (US); David E. Hockey, Brockport, NY (US)

(73) Assignee: Heidelberger Druckmaschine AG, Heidelberg (DE)

( * ) Notice: Subject to any disclaimer, the term of this patent is extended or adjusted under 35 U.S.C. 154(b) by 0 days.

(21) Appl. No.: 09/629,394

(22) Filed: Aug. 1, 2000

(51) Int. Cl.[7] ..... G03G 15/00
(52) U.S. Cl. ..... 399/49; 399/81
(58) Field of Search ..... 399/49, 72, 60, 399/27, 81, 138

(56) References Cited

U.S. PATENT DOCUMENTS

| | | | | |
|---|---|---|---|---|
| 4,277,162 A | | 7/1981 | Kasahara et al. | |
| 4,377,338 A | * | 3/1983 | Ernst | 399/49 |
| 4,860,059 A | * | 8/1989 | Terashita | 355/38 |
| 4,894,685 A | * | 1/1990 | Shoji | 399/39 |
| 5,122,835 A | * | 6/1992 | Rushing et al. | 399/49 |
| 5,148,289 A | * | 9/1992 | Nishiyama et al. | 358/300 |
| 5,150,155 A | * | 9/1992 | Rushing | 399/39 |
| 5,493,321 A | * | 2/1996 | Zwadlo | 347/131 |
| 5,583,644 A | * | 12/1996 | Sasanuma et al. | 358/296 |
| 5,710,958 A | * | 1/1998 | Raj | 399/49 |
| 5,784,667 A | * | 7/1998 | Mestha et al. | 399/49 |
| 6,229,972 B1 | * | 5/2001 | Rushing | 399/74 |

FOREIGN PATENT DOCUMENTS

EP 0 871 080 A1 10/1998

OTHER PUBLICATIONS

Patent Abstracts of Japan 09138532.

* cited by examiner

*Primary Examiner*—Robert Beatty

(57) ABSTRACT

An electrophotographic (EP) image-forming device and related method are provided for on-line quantitative assessment of the image formation and development process. The EP image-forming device has a primary charger, an exposure device, a toning station, a transfer charger, a fusing station, and a cleaner operatively disposed about a photoconductor. A transmission densitometer is positioned adjacent to the photoconductor. The densitometer determines the successive tones corresponding to a plurality of step areas of a toner pattern for each image frame. The density readings are stored in memory. The photoconductor densities are subtracted from the combined densities to provide measured toner densities, which are then averaged for each step area. The average measured toner densities or voltage readings are compared to the aim toner densities or voltage readings for each step in the step tablet which are displayed in an output chart to quantitatively assess the image quality of the image-forming process. Preferably, every image frame on the photoconductor is assessed successively.

12 Claims, 4 Drawing Sheets

EP Process Step Table

| | Aim (volts) | Actual (volts) | | Aim (volts) | Actual (volts) |
|---|---|---|---|---|---|
| 0 | 0.00 | 0.50 | 8 | 0.31 | 1.16 |
| 1 | 0.10 | 0.10 | 9 | 0.38 | 1.35 |
| 2 | 0.13 | 0.19 | 10 | 1.07 | 1.51 |
| 3 | 0.27 | 0.32 | 11 | 1.22 | 1.72 |
| 4 | 0.37 | 0.49 | 12 | 1.41 | 1.50 |
| 5 | 0.48 | 0.45 | 13 | 1.62 | 20.9 |
| 6 | 0.50 | 0.53 | 14 | 1.35 | 2.23 |
| 7 | 0.69 | 0.38 | 15 | 1.45 | 2.80 |
| | | | | | 2.65 |

Interframe Patch (volts)

FIG. 3

IMAGE-FORMING DEVICE HAVING ON-LINE IMAGE QUALITY ASSESSMENT AND RELATED METHOD

FIELD OF THE INVENTION

This invention relates generally to image forming devices and methods having image quality diagnostics. More particularly, this invention relates to electrophotographic image-forming devices and methods having image quality assessment by on-line measurement of toner density.

BACKGROUND OF THE INVENTION

Electrophotographic image-forming devices are used to transfer images onto paper or other medium. Generally, a photoconductor is selectively charged and optically exposed to form an electrostatic latent image on the surface. Toner or other developing material is deposited onto the photoconductor surface. The toner is charged, thus adhering to the photoconductor surface in areas corresponding to the electrostatic latent image. The toner image is transferred to paper or other medium. The paper usually is heated for the toner to fuse to the paper. The photoconductor is then refreshed—cleaned to remove any residual toner and charge—to make it ready for another image.

In many electrophotographic image-forming devices, an output copy of a test reference is visually inspected to evaluate the image formation and development process. The test reference is essentially a "perfect" image of the desired output of the electrophotographic image-forming device. A service technician makes a copy of the photographic test reference and compares the copy to the test reference. If image quality is unacceptable, the toner density is adjusted.

The toner density amongst other factors affects the output image quality. Mechanical damage to any of the electrophotographic subsystems may introduce artifacts. The lifetime of consumables may degrade performance. Material fatigue may affect the spatial distribution of the toner (the image may have the correct toner density, but not be in focus).

The test reference approach provides a qualitative assessment of the image quality, which provides an inferential evaluation of the toner density on the photoconductor. The toner density is adjusted to adjust the image quality. While the image quality may visibly appear to be fine, service, maintenance and other problems may not be readily visible especially in the early stages. Generally, such problems have to become "visible" before a user or service technician knows the problem exists.

In addition, the test reference approach also is not well suited for performing maintenance and service routines. Some variations in toner density, while sufficient to for proper maintenance and service, may not be visible. Due to its qualitative nature, the test reference approach has varying results depending on the service technician's experience level, training, and other subjective factors. As a result, the test reference approach causes maintenance and service routines to be performed prior to or later than the time they are needed. Also, service problems and maintenance are not early identified. Consequently, the image-forming device experiences unexpected downtime and additional repair and maintenance costs.

The use of greyscale tone reproduction magnifies the difficulties of using this test reference approach to assess the image formation and development process. In greyscale tone reproduction, the toner is applied in variable amounts from no toner to maximum toner to create an image. The density of the toner determines whether a portion of the image is black, white, or one of various shades of grey. These variations in toner density make the quantitative evaluation of greyscale electrophotographic processes by visual inspection virtually impossible.

To avoid the difficulties associated with visual inspections of the test reference, commercially available lightness meters and densitometers provide off-line visual evaluation and measurement of the printed density. However, these techniques require additional equipment and additional set-up time to use the equipment. They tend to extend or delay service calls and also are inferential evaluations of the toner densities on the photoconductor.

Accordingly, there is a need to provide an on-line, quantitative assessment of the image quality in an electrophotographic image-forming device.

BRIEF SUMMARY OF THE INVENTION

The present invention provides an electrophotographic (EP) image-forming device and related method for on-line quality assessment of the image formation and development process. The EP image-forming device and method quantitatively assess the density of the toner applied to the photoconductor.

A toner density map of the entire photoconductor is provided in one aspect of the present invention. The EP image-forming device has a reference system for locating positions on the surface of the photoconductor. The reference system uses a reference point on the photoconductor and a sequencer to determine locations from the reference point along the length or circumference of the photoconductor.

The reference system identifies the locations of density measurements. For every density reading taken, there is a reference position. In this manner, the density readings are taken and evaluated at the same location. The measured toner densities for different locations may be assembled to provide a density map of the toner on the photoconductor.

The EP image-forming device has a photoconductor mounted to rotate on support rollers. A primary charger, an exposure device, a toning station, a transfer charger, a fusing station, and a cleaner are operatively disposed about the photoconductor. A transmission densitometer has a light emitter and a light collector, which are operatively disposed adjacent to the photoconductor. The densitometer also is connected to a microprocessor having a memory. The microprocessor in turn is connected to input and output interfaces. While single components are illustrated, there may be multiples of any components including the densitometer.

In the EP image-forming device of the present invention, an image frame on the photoconductor is charged. A step tablet or test image is optically exposed to form an electrostatic image on the image frame. Preferably, the step table is for greyscale tone reproduction. The electrostatic image has step areas corresponding to the steps of the step tablet. The toner station is disabled so there is no toner application at this time.

The photoconductor density is determined for each step area of the step tablet on the image frame. Preferably, five or more photoconductor density measurements are taken of each step area by the transmission densitometer.

The densitometer measures a voltage reading corresponding to the amount of light energy passing through the photoconductor on an optical path between the light emitter and light collector. The voltage reading corresponds to the density of the toner. The photoconductor voltage readings are stored separately in memory, with each photoconductor voltage reading identified as to its location on the photoconductor.

The image frame is charged for a second time. The transfer station and fusing device are momentarily disabled so the photoconductor passes without any interaction. The cleaner removes any charge from the photoconductor.

The step tablet is optically exposed to form an electrostatic image on the image frame for a second time. The electrostatic image has step areas corresponding to the steps of the step tablet. These step areas are the same as when the photoconductor voltage readings were taken.

The toner station deposits toner on the image frame. The toner forms a toner image corresponding to the electrostatic image, which corresponds to the step tablet.

The combined photoconductor and toner density is determined for each step area of the step tablet on the image frame. Again, preferably, five density measurements are taken of each step area by the transmission densitometer. These combined voltage readings also are stored separately in memory, with each combined voltage reading again identified as to its location on the photoconductor.

The average measured toner density is ascertained for each step area of the image frame. For each step area, the photoconductor voltage reading is subtracted from the combined voltage reading at the same location to provide a measured toner voltage reading or density for that location. The measured toner voltage readings are averaged for each step in the step tablet to provide an average measured toner voltage reading for each step.

The average measured toner voltage readings are compared to the aim toner voltage readings for each step in the step tablet. The aim toner voltage readings are according to the manufacturer's specifications for the EP image-forming device.

The measured toner voltage readings are indicative of the toner density. Too high a measured toner voltage reading means there is too much toner. Conversely, too low a measured toner voltage reading means there is too little toner being applied. In either case, the toner application may be adjusted and retested until the measured toner voltage reading equals or is within an acceptable range of the aim toner voltage.

Preferably, every image frame on the photoconductor is assessed successively. If each the image frame on the photoconductor is assessed, then the average measured toner voltage reading is representative of the step on the step tablet for an entire revolution of the photoconductor.

The present invention quantitatively assesses the image quality of an EP image-forming device, using a reference system to provide a toner density map of the toner on the surface of the photoconductor. Actual or measured densities of toner are compared with aim densities according to the manufacture's specifications and independent of the operator's subjective visual inspections and comparisons. The densities of the toner are indicative of the image quality in an EP process.

The following drawings and description set forth additional advantages and benefits of the invention. More advantages and benefits are obvious from the description and may be learned by practice of the invention.

BRIEF DESCRIPTION OF SEVERAL VIEWS OF THE DRAWINGS

The present invention may be better understood when read in connection with the accompanying drawings, of which:

FIG. 3 is an output chart showing an example comparison of aim and measured toner voltages according to the present invention.

DETAILED DESCRIPTION OF THE INVENTION

Figure 1:
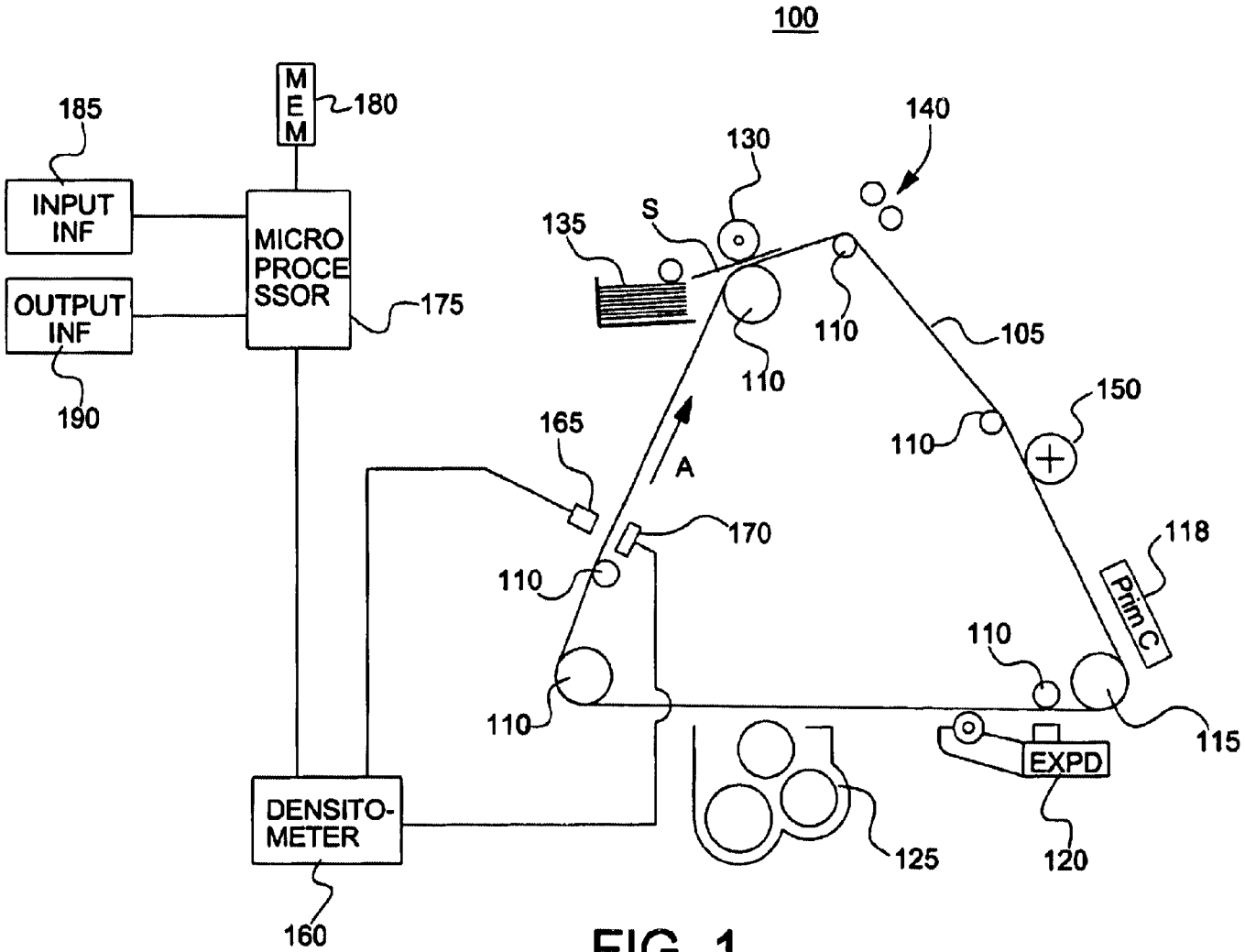
FIG. 1 shows a block diagram of an electrophotographic image-forming device according to the present invention.

FIG. 1 shows a block diagram of an electrophotographic (EP) image-forming device 100 according to an embodiment of the present invention. The EP image-forming device 100 has a photoconductor 105 operatively mounted on support rollers 110 and motor 115, which moves the photoconductor 105 in the direction indicated by arrow A. The EP image-forming device 100 also has a primary charger 118, an exposure device 120, a toning station 125, a transfer charger 130, a fusing station 140, and a cleaner 150 operatively disposed about the photoconductor 105. While the photoconductor 105 has a belt and roller-mounted configuration, the photoconductor 105 may be mounted using a drum or other suitable configurations. While particular configuration and arrangements are shown for the EP image-forming device 100, the present invention may use other configurations and arrangements including those with additional features.

The EP image-forming device 100 also has a densitometer 160 connected to a light emitter 165 and a light collector 170. The densitometer 160 is connected to a microprocessor 175 having a memory 180. The microprocessor 175 is connected to an input interface 185 and an output interface 190. The microprocessor 175 may be connected to communicate with other microprocessors in the EP image-forming device 100. The input interface 185 may be a keyboard, a touch screen, or the like. The output interface 190 may be a printer, a cathode ray tube (CRT) display, or the like. The input and output interfaces 185, 190 may be the same component. There may be multiple densitometers as well as other components.

A toner density map of the entire photoconductor 105 is provided in one aspect of the present invention. The EP image-forming device 100 has a reference system for locating positions on the surface of the photoconductor 105. The reference system uses a reference point (not shown) on the photoconductor 105 and a sequencer (not shown) to determine locations from the reference point along the length or circumference of the photoconductor 105. Preferably, a seam in a belt-type photoconductor is the reference point. The process patch or other fixed point on the photoconductor may be used as the reference point. The sequencer is essentially a timer, providing the time for the photoconductor 105 to progress from the reference point to a particular location. By knowing the speed of the photoconductor 105 for the measured time, the location on the photoconductor 105 may be determined. The sequencer may be other measuring devices and may determine the location by other means. Alternate reference systems also may be used.

The reference system is used to identify the locations of density measurements. For every density reading taken, there is a reference position. In this manner and as described below, a density reading of the photoconductor may be subtracted from the density reading of the photoconductor and toner at the same location, thus providing the measured toner density for that location. The measured toner densities for different locations may be assembled to provide a density map of the toner on the photoconductor 105.

In use, the primary charger 118 electrostatically charges an image frame on the surface of the photoconductor 105.

The image frame corresponds to the size of image to be formed and may effectively cover the entire surface of the photoconductor 105. Preferably, the photoconductor 105 is designed to have multiple image frames.

The photoconductor 105 is rotated to pass the charged image frame under the exposure device 120. The exposure device 12.0 optically exposes the charge image frame to create an electrostatically latent image on the photoconductor 105.

The photoconductor 105 rotates to pass the electrostatic image under the toning station 125. The toning station 125 deposits toner or another developing material onto the surface of the photoconductor 105. The toner is charged, thus adhering to the electrostatic image. While a dry toner is described, a liquid or similarly suitable developing material may be used.

The photoconductor 105 rotates to pass the electrostatic image under the transfer charge 130. The transfer charger 130 transfers the electrostatic toner image from the photoconductor 105 to paper or other another medium selected to hold the image. The paper S is dispensed from the paper supply and passes between the transfer charger 130 and the photoconductor 105. The paper S passes through the fusing station 140, where the toner fuses onto the paper.

The photoconductor 105 rotates to pass the image frame through the cleaner 150. The cleaner removes any residual toner and charger, thus refreshing the photoconductor for another image. While these operations are described apparently in steps, they preferably occur sequentially and continuously as the photoconductor rotates through a cycle.

The densitometer 160 is connected to the light emitter 165 and the light collector 170. The light emitter 165 and light collector 170 are oppositely disposed adjacent to the photoconductor 105 and downstream from the developer 115—after the position where toner is applied. Preferably, the light emitter 165 is adjacent to the surface where the toner is applied.

The densitometer 160 is shown preferably as a transmission densitometer. However, a reflection densitometer may be used as well as any other density measuring device for measuring the toner densities on the photoconductor 105. If a reflection densitometer were used, the positions of the light emitter 165 and the light collector 170 would need to be changed appropriately. The density measuring device may not require the light emitter 165 and light collector 170.

The optical path of the light emitter 165 to the light collector 170 passes through the photoconductor 105. The densitometer 160 produces voltage readings proportional to the absorption of light in the optical path. The voltage readings are indicative of the density of the photoconductor 105 and/or any toner on the surface. The voltage readings from the densitometer 160 are biased toward higher voltages as the opacity of the photoconductor 105 increases; i.e., as the amount of toner increases on the photoconductor 105. To eliminate the variability of the photoconductor 105, voltage readings of the photoconductor without toner may be subtracted from voltage readings of the photoconductor with toner. The densitometer 160 provides the voltage readings to the microprocessor 175.

The microprocessor 175 provides the voltage readings to the output interface 190. The voltage readings may be stored in the memory 180 for further analysis and/or later transmission to the output interface. The voltage readings may be transmitted as received from the densitometer 160 or may be amplified or otherwise augmented to improve the transmission to the output interface 190. The microprocessor 175 also may convert the voltage readings into other appropriate factors such as a density or thickness or the like. In addition, the microprocessor 175 receives commands and instructions through the input interface 185.

In the present invention, the electrophotographic image-forming device 100 assesses the electrophotographic process to determine whether the toner density and hence the image quality is in accordance with the manufacturer's specifications. The EP image-forming device 100 verifies whether the density of the toner on the photoconductor 105 corresponds to the density required for the tonescale in the specifications. In a greyscale tone reproduction process, the toner densities vary according to steps. In this case, the toner densities of the various steps are assessed.

Figure 2:
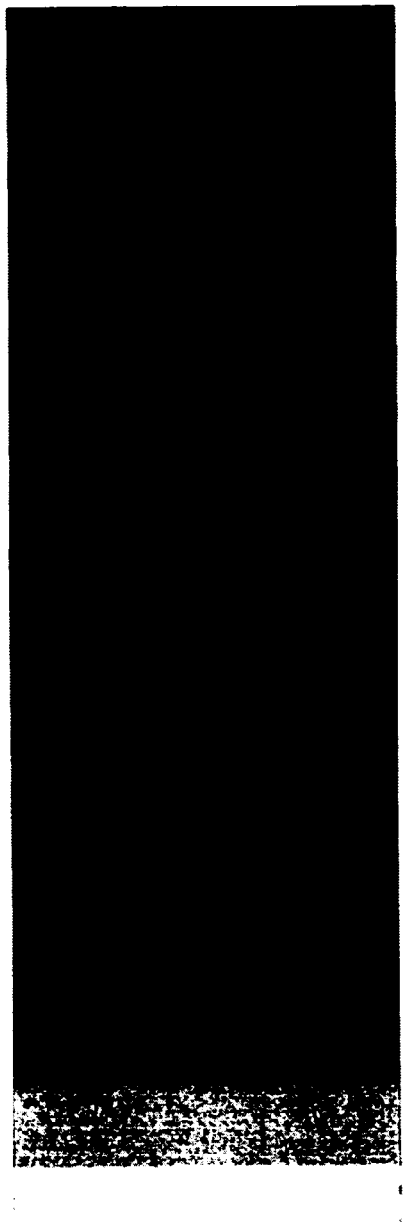
FIG. 2 shows a step tablet for an electrophotographic image-forming device according to the present invention.

FIG. 2 shows a step tablet 200 for assessing the various densities of toner in a greyscale tone reproduction system. The step tablet 200 is an image with successive tones corresponding to the steps of toner density associated with a particular electrophotographic image-forming device. For example, the step tablet in FIG. 2 shows 16 steps ranging from no exposure (no toner) 210 to maximum exposure (maximum toner) 220.

To assess the electrophotographic process, the EP image-forming device 100 prints at least one image of the step tablet. Preferably, the number of images corresponds to the number of image frames that fit along the length or circumference of the photoconductor. If more than one image is printed, the images are successively printed. By successively printing a number of images corresponding to the number image frames on the photoconductor, the entire surface of the photoconductor may be assessed. Preferably, six image frames are provided on the photoconductor 105. Accordingly, the EP image-forming device 100 prints six successive images to assess the EP process. In addition, a process patch (not shown) is located at an inter frame area of the photoconductor 105. The process patch is exposed to the maximum toner density, $D_{max\text{-}density}$, or any true density.

Printed output of the EP image-forming device 100 is not necessary as long as toner is applied to the photoconductor 105. However, the printed output is incidental to the operation of the EP image-forming device 100. The printed images permit visual evaluation and off-line measurement of the printed density with commercially available lightness meters and densitometers. Moreover, the printed output also allows a user or service technician to identify other image quality problems not associated with toner density such as photoconductor scratches, and mechanical or electrical problems in the development process.

The steps of the step tablet correspond to the step areas on the image frame. Each of the step areas has a specified location determined by the reference system. While the printing process is in progress, the densitometer 160 takes at least one density reading of each step area of each image frame.

The density reading is a voltage reading as the light emitter 165 directs light through the toner and photoconductor 105 to the light collector 170. Better readings are obtained by improving the signal-to-noise ratio for each step. Preferably, the optical path covers 0.5 inch of the photoconductor surface. Preferably, at least five density or voltage readings are taken of each step area in each image frame. The five readings are taken in five different locations of the photoconductor, but all within the same step area. More readings increase the accuracy of the final voltage/density readings. These voltage readings are indicative of the optical properties, i.e., the density, of the photoconductor 105 with toner. The combined voltage readings are stored separately by the microprocessor 175 in the memory 180.

To eliminate the variability of the photoconductor 105, the density measurements are also done without any toner applied to the photoconductor 105. These density measurements are preferably taken prior to the density measurements when toner is applied. Using the reference system, the photoconductor density is determined for each step area and subsequent density readings of the photoconductor and toner.

For example, six successive images are taken of the step tablet. The toning station is temporarily disabled. The six images complete one revolution of the photoconductor 105. Since no toner is applied, a blank or similar image may be used as long as these photoconductor voltage readings are in corresponding step areas on the image frame where the step tablet readings with toner are taken.

The densitometer takes at least one, preferably five, photoconductor voltage readings of each step area in each image frame. The five readings are taken in five different locations of the photoconductor, but all within the same step area. The reference system identifies the locations of the photoconductor voltage readings so the voltage readings of the toner and photoconductor are taken in the same locations. The process patch also is measured to provide its photoconductor voltage reading. The photoconductor voltage readings correspond to the optical characteristics, i.e., the density, of the photoconductor 105. The photoconductor-voltage readings are stored in the memory 180.

To obtain the densities of the toner in each step of the step tablet, the photoconductor voltage reading is subtracted from the matching combined voltage reading for same step area in the same image frame (the reference system identifies the voltage readings for the same location). The result is a measured toner voltage reading for each step in each image frame. The measured toner voltage reading is indicative of the toner density within that particular step area for that particular image frame. Similarly, the measured toner voltage reading for the process patch is obtained, which is indicative of the maximum toner density.

The measured toner voltage readings for a particular step area in all of the image frames are averaged to give an average measured toner voltage reading for the particular step in the step table. For example, if there are five measured toner voltage readings for each step in each image frame and there are six image frames, the 30 measured toner voltage readings are averaged to provide an average measured toner voltage for that step area—which is indicative of the toner density for that particular step of the step tablet over one complete revolution of the photoconductor 105. The process patch is similarly averaged to give the measured toner voltage reading for the maximum toner density, $D_{max\text{-}density}$, or any true density. These measured toner voltage readings correspond to the optical characteristics of the toner and hence its density.

An example of a summary for a typical result of such averages over six successive frames for all steps including the process patch is shown in FIG. 3. According to one aspect of the present invention, the printed frames are valuated successively. A frame-by-frame analysis based on an average of five readings per step can determine localized defects in the photoconductor causing the density of one or more steps not to be at the desired aim value.

The average measured toner voltage reading for each step is compared to an aim toner voltage reading for the step. The aim toner voltage reading corresponds to the manufacturer's specification for the toner density. The measured toner voltage readings are indicative of the toner density. A measured toner voltage reading higher than the aim toner voltage reading means there is too much toner being applied for that step in the step tablet. Conversely, a measured toner voltage reading lower than the aim toner voltage reading means there is too little toner being applied for that step in the step tablet. In either case, the toner application may be adjusted and retested until the measured toner voltage reading equals or is within an acceptable range of the aim toner voltage.

The microprocessor 175 provides the measured toner voltage readings to the output interface 190. The measured toner voltage readings may be provided in a chart similar to FIG. 3 for comparing the measured toner voltage readings to the aim toner voltage readings. The measured toner voltage readings may be stored in the memory 180 to provide historic test data or downloaded to a data storage device (not shown).

The assessment of the electrophotographic process maybe performed as a stand-alone diagnostic routine or as part of a larger diagnostic routine. Users and service technicians may initiate the assessment through the input interface 185. The assessment also may be initiated as part of a self-check routine with a warning signal to the user if any discrepancies are found between the measured and aim toner voltage readings.

Figure 4:
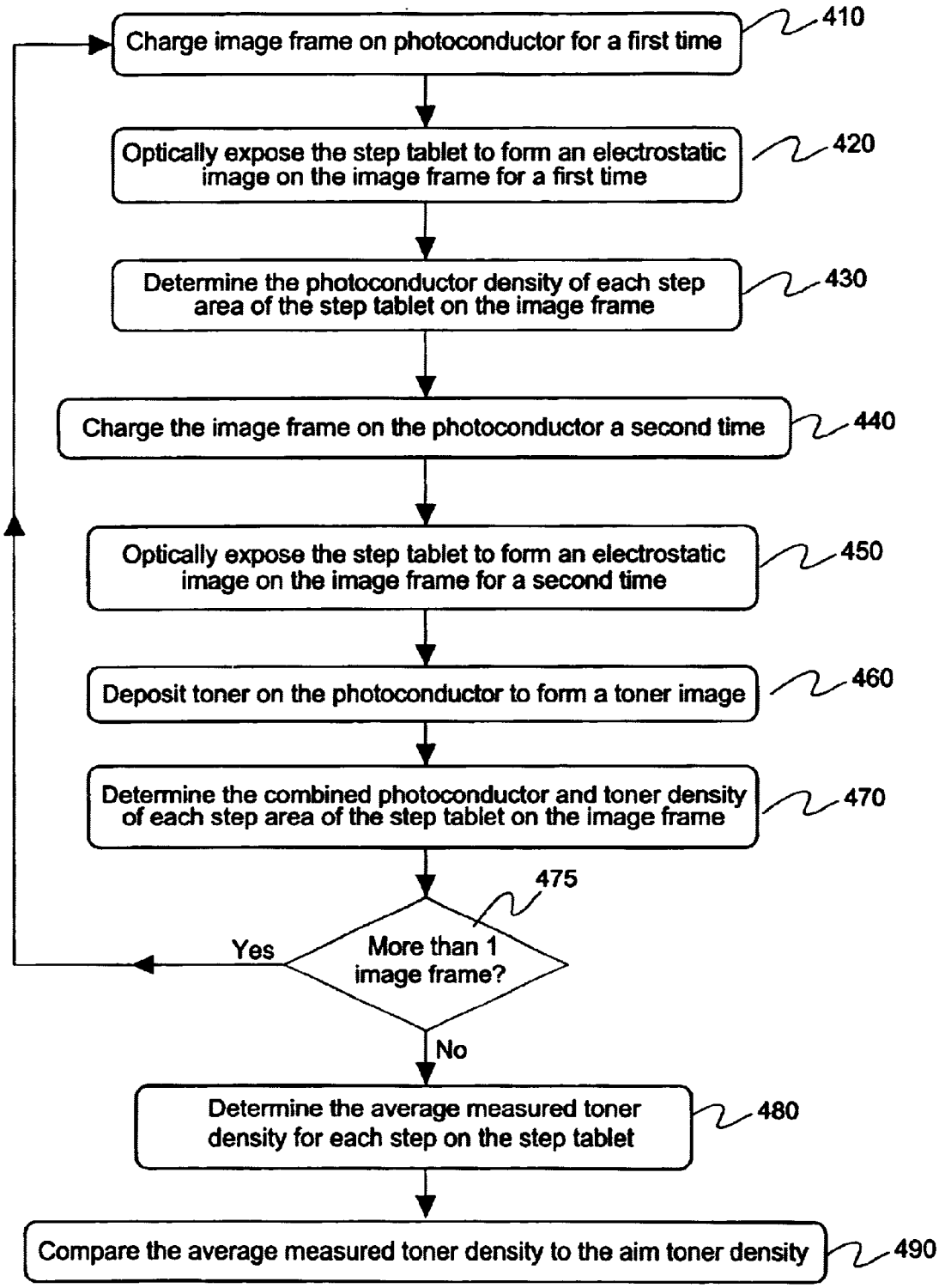
FIG. 4 shows a flowchart showing a method of on-line image quality assessment according to the present invention.

FIG. 4 shows a flowchart of the method for an on-line image quality assessment of an EP image-forming device according to the present invention. In Step 410, an image frame on a photoconductor is charged for the first time. The photoconductor may have a belt and roller, drum, or other suitable configuration.

In Step 420, a step tablet or test image is optically exposed to form an electrostatic image on the image frame for a first time. Preferably, the step table is for greyscale tone reproduction and has 16 density steps. The electrostatic image has step areas corresponding to the steps of the step tablet. The process patch is similarly exposed. The toner station is disabled so the photoconductor passes without any toner application.

In Step 430, the photoconductor density is determined for each step area of the step tablet on the image frame. Preferably, five photoconductor density measurements are taken of each step area by a transmission densitometer, which has a light emitter and a light collector operatively disposed adjacent to the photoconductor. The densitometer measures the density as a voltage reading corresponding to the amount of light energy passing through the photoconductor on an optical path between the light emitter and light collector. The photoconductor voltage readings of the process patch are similarly made. The photoconductor voltage readings are stored separately in memory, with each photoconductor voltage reading identified as to its location on the photoconductor. Other density measurement means may be used in place of the densitometer. The transfer station and fusing device are disabled so the photoconductor passes without any interaction. The cleaner removes any charge from the photoconductor.

In Step 440, the image frame is charged for a second time.

In Step 450, the step tablet or test image is optically exposed to form an electrostatic image on the image frame for a second time. As in Step 420, the electrostatic image has step areas corresponding to the steps of the step tablet. The step areas in Step 450 are the same as the step areas in Step 420.

In Step 460, the toner station is activated to deposit toner on the image frame. The toner forms a toner image corresponding to the electrostatic image, which corresponds to the step tablet. The process patch also receives toner.

In Step 470, the photoconductor and toner density is determined for each step area of the step tablet on the image frame. Preferably, five density measurements are taken of each step area by a transmission densitometer in a similar fashion as Step 430. The densitometer measures the density as a voltage reading corresponding to the amount of light energy passing through the photoconductor and toner on an optical path between the light emitter and light collector. These combined voltage readings also are separately stored in memory, with each combined voltage reading again identified as to its location on the photoconductor.

In Step 475, Steps 410 through Steps 470 are repeated if the photoconductor has more than one image frame, Preferably, Steps 410 through Steps 470 are repeated in parallel for each image frame. For example, the image frames are charged successively in Step 410. The image frames are exposed to the step tablet successively in Step 420, and so on. In this manner, the toner density may be assessed for the entire length or circumference of the photoconductor.

In Step 480, the average measured toner density is ascertained for each step of the step tablet (if there is more than one image frame, it is done for all of the image frames). For each location on the image frame, the photoconductor voltage reading is subtracted from the combined voltage reading to provide a measured toner voltage reading or density for that location. The measured toner voltage readings are averaged for each step in the image frame to provide an average measured toner voltage reading for each step. If each image frame on the photoconductor is assessed, then the average measured toner voltage reading is representative of the step on the step tablet for an entire revolution of the photoconductor.

In Step 490, the average measured toner voltage readings or densities are compared to the aim toner voltage readings or densities for each step in the step tablet. The measured and aim toner voltage readings are presented on the output interface in table format similar to the example shown in FIG. 3. The aim toner voltage readings are according to the manufacturer's specifications for the EP image-forming device.

Alternatively, the photoconductor may bypass Step 440 (charging a second time) and Step 450 (optically exposed a second time). After the photoconductor densities are determined (Step 430), the photoconductor may rotate to the toning station without interaction from the other processing components. The photoconductor could rotate past the other components or could reverse to pass through the toning station a second time for the toner to be applied. However, reversing the photoconductor does create additional operating complexities if the photoconductor has multiple image frames. Additionally, a second densitometer may be provided prior to the toning station to obtain the photoconductor densities prior to application of the toner.

While the invention has been described and illustrated, this description is by way of example only. Additional advantages will occur readily to those skilled in the art, who may make numerous changes without departing from the true spirit and scope of the invention. For example, the voltage readings may be used to determine area specific problems with the photoconductor. The voltages readings may be used, for example, to determine whether a specific step area has a surface or other problem. The operator could review each of the measured toner voltage readings and the other voltage readings. Additional statistical analysis could be provided to identify problem areas. Therefore, the invention is not limited to the specific details, representative devices, and illustrated examples in this description. Accordingly, the scope of this invention is to be limited only as necessitated by the accompanying claims.

What is claimed is:

1. A method for on-line image quality assessment of an image-forming device having a photoconductor with multiple image frames and an on-line density measuring device comprising:

applying in each image frame a toner image having successive tones corresponding to a plurality of step areas of toner density;

measuring multiple toner densities with the on-line density measuring device for a plurality of locations within the step areas;

averaging the measured toner densities within the steps; and, displaying an output chart enabling an operator to compare multiple readings indicative of averaged toner densities with corresponding aim values.

2. A method in accordance with claim 1, further comprising the step of providing a map of the toner density on the photoconductor.

3. A method in accordance with claim 1, wherein the output chart indicates averaged toner density for each step area of each image frame.

4. A method in accordance with claim 1, wherein the displaying step provides readings indicative of toner density for a particular step of the step tablet over one complete revolution of the photoconductor.

5. A method in accordance with claim 1, further comprising the step of determining localized defects in the photoconductor causing the density of one or more steps not to be at the desired aim value.

6. A method in accordance with claim 1, wherein multiple readings for a particular step area in all of the image frames are averaged to give an average measured toner voltage reading for that particular step in the step table.

7. An image-forming device having a photoconductor with multiple image frames and comprising:

a toning station for applying in each image frame a toner image having successive tones corresponding to a plurality of step areas of toner density;

an on-line density measuring device for measuring multiple toner densities with the on-line density measuring device for a plurality of locations within the step areas;

a microprocessor for averaging the measured toner densities within the steps; and, a display device for displaying an output chart enabling an operator to compare multiple readings indicative of averaged toner densities with corresponding aim values.

8. A device in accordance with claim 7, wherein the display provides a map of the toner density on the photoconductor.

9. A device in accordance with claim 7, wherein the output chart indicates averaged toner density for each step area of each image frame.

10. A device in accordance with claim 7, wherein the display provides readings indicative of toner density for a particular step of the step tablet over one complete revolution of the photoconductor.

11. A device in accordance with claim 7, wherein the display provides determination of localized defects in the photoconductor causing the density of one or more steps not to be at the desired aim value.

12. A device in accordance with claim 7, wherein multiple readings for a particular step area in all of the image frames are averaged by the microprocessor to give an average measured toner voltage reading for that particular step in the step table.

* * * * *